United States Patent [19]

Wu

[11] 4,278,860

[45] Jul. 14, 1981

[54] ARC DRIVEN SINGLE PRESSURE TYPE CIRCUIT BREAKER

[75] Inventor: Jiing-Liang Wu, Chalfont, Pa.

[73] Assignee: Gould Inc., Rolling Meadows, Ill.

[21] Appl. No.: 63,132

[22] Filed: Aug. 3, 1979

[51] Int. Cl.[3] ..... H01H 33/88

[52] U.S. Cl. ..... 200/148 R; 200/148 A

[58] Field of Search ..... 200/148 A, 150 B, 150 D, 200/150 G, 148 R

[56] References Cited

U.S. PATENT DOCUMENTS

| | | | |
|---|---|---|---|
| 3,814,883 | 6/1974 | Milianowicz | 200/150 G X |
| 4,011,421 | 3/1977 | Thaler | 200/148 A |
| 4,079,218 | 3/1978 | Spiegel | 200/148 A |
| 4,105,880 | 8/1978 | Rapp et al. | 200/148 A |

FOREIGN PATENT DOCUMENTS

| | | | |
|---|---|---|---|
| 625926 | 2/1936 | Fed. Rep. of Germany | 200/150 D |

*Primary Examiner*—James R. Scott

*Attorney, Agent, or Firm*—Ostrolenk, Faber, Gerb & Soffen

[57] ABSTRACT

A sulfur hexafluoride interrupter structure uses sulfur hexafluoride at supercritical pressure and includes two spaced pistons of different diameters disposed on opposite sides of the contact arcing region. The pistons are connected to a source of biasing force such as a spring and assume a static position dependent on the opposing force of the spring and of the differential pressure on the pistons. During contact interruption the initial arc between the separating contacts produces a high pressure in the contact space which is transmitted to the differential pistons and causes the pistons to move quickly in order to move fluid through the separating contacts. The piston biasing spring is also charged as the movable contact moves toward a disengaged position. High pressure surges created due to the arc energy are thus absorbed during the opening operation and a considerable part of the operating force needed to open the contacts and to move fluid is derived from the arc energy.

5 Claims, 3 Drawing Figures

ARC DRIVEN SINGLE PRESSURE TYPE CIRCUIT BREAKER

BACKGROUND OF THE INVENTION

This invention relates to single pressure circuit interrupters and more specifically relates to a circuit interrupter using sulfur hexafluoride in the high density state and preferably in the liquid state wherein the arc energy of the arc produced between the separating contacts is used to cause the fluid sulfur hexafluoride to sweep rapidly through the separating contacts in order to deionize the arc drawn therebetween and further to provide at least part of the energy required to separate the cooperating contacts.

It is well known that the current interrupting ability of a sulfur hexafluoride interrupter can be increased by increasing the gas pressure of the sulfur hexafluoride. In fact, it is known that interrupters using sulfur hexafluoride as the arc interrupting medium can have the gas pressure increased well above its critical pressure of 537 PSI and in fact can be as high as 5800 PSI. A disclosure of a circuit interrupter operating at this relatively high pressure is contained in U.S. Pat. No. 3,842,227 entitled CIRCUIT BREAKER HAVING DIELECTRIC LIQUID UNDER PRESSURE.

It is also known to use sulfur hexafluoride at supercritical pressure in puffer type circuit breakers. Thus a single piston type interrupter of the type shown in U.S. Pat. No. 4,009,358 entitled ELECTRIC CIRCUIT-BREAKER FOR ALTERNATING CURRENTS and a dual piston type interrupter of the type shown in Application Ser. No. 843,573, filed Oct. 19, 1977 in the name of R. D. Garzon, entitled LIQUID $SF_6$ PUFFER TYPE CIRCUIT INTERRUPTER can be used. In these devices interruption is obtained by causing one or more pistons to be moved while separating a pair of electric contacts in order to initiate an arc and at the same time forcing the sulfur hexafluoride fluid to flow through the arcing region to enhance arc quenching.

Single piston designs utilizing sulfur hexafluoride in the past have been subject to several disadvantages, particularly when the sulfur hexafluoride is at subcritical temperature and thus in its liquid state. Thus, in such devices, very high energy is required for the driving mechanism; an extremely high pressure surge is produced during high current arcing; and there is a relatively low dielectric withstand after low current interruption at low temperature. High energy is required for the driving mechanism since the dielectric fluid is a high density and high viscosity fluid at supercritical pressures. The high pressure surge during high current arcing is attributed to the low compressibility of liquid sulfur hexafluoride. Moreover, at maximum arcing duty a pressure surge due to the arcing could reach several thousand pounds per square inch, thus creating serious mechanical problems within the interrupter. At the other end of the spectrum, of interruption of extremely low current and low temperature, there is a substantial decrease in the pressure of the sulfur hexafluoride and therefore a decrease in dielectric withstand due to the expansion of the sulfur hexafluoride volume during the circuit interrupter operation.

When using a dual piston arrangement with the pistons disposed on opposite sides of the interrupting contacts, the sulfur hexafluoride volume within the interrupter is virtually constant since identical piston diameters on both sides of the contacts are usually used.

Therefore, there will be no decrease in dielectric withstand capability after interruption. However, the problem of a high pressure surge due to arcing will be more severe than in the case of the single piston design. Moreover, the driving energy requirement for the dual piston design will still be very high.

BRIEF DESCRIPTION OF THE PRESENT INVENTION

The principal object of the present invention is to eliminate the above-mentioned problems which are inherent in the prior art single piston and dual piston designs using sulfur hexafluoride at supercritical pressure. A further object of this invention is to produce a very simply constructed interrupter structure requiring less maintenance than prior art interrupters while still obtaining a very high rating for fault current clearing.

In accordance with the present invention, the arc energy which is produced between the separating contacts is used to drive a differential piston arrangement consisting of pistons of different diameters arranged on the opposite sides of the arcing region. The piston structure is then connected to the circuit interrupter supporting frame through a biasing spring which is charged during the contact interruption operation.

In accordance with the invention, the $SF_6$ medium used is high density $SF_6$. In the high density state, which could be liquid or gaseous, the $SF_6$ will have low compressibility and can readily transform the thermal energy released by an electric arc into mechanical energy through the means of pressure rise of the $SF_6$. Note that in the high density state, one cannot differentiate between the liquid and gaseous states.

The arrangement of the present invention accomplishes two objectives. First, it drastically reduces the driving energy requirement of the operating mechanism and secondly it reduces the pressure surge due to arcing. This is because the energy in the sulfur hexafluoride medium during arcing is extracted from the medium to do useful work including producing a flow of fluid through the separating contacts and to assist in moving the movable contact toward its disengaged position.

Moreover, it will be seen in the following that the novel invention has the advantage of increasing the life of the interrupters since the pistons need not move through a substantial stroke when the interrupter is opened under normal load current conditions.

Finally, it will be found that the novel invention has a self-regulatory feature, whereby the piston movement and thus the change in the sulfur hexafluoride pressure will be adjusted in accordance with the current being interrupted.

DETAILED DESCRIPTION OF THE DRAWINGS

Figure 1:
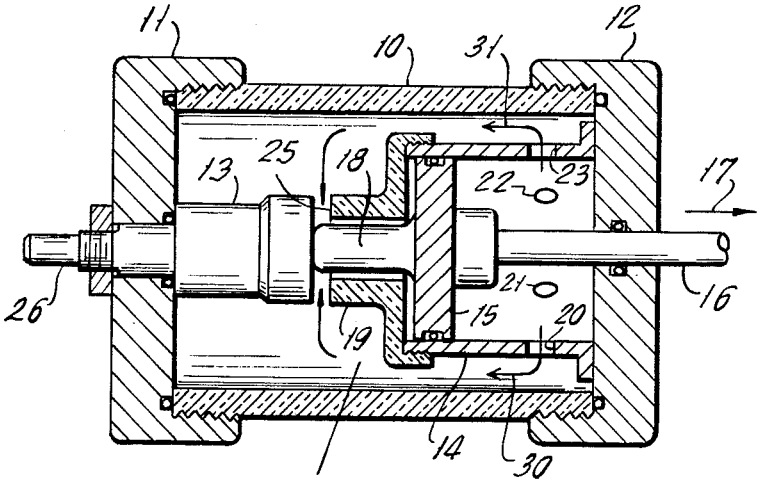
FIG. 1 (PRIOR ART)
FIG. 1 is a cross-sectional schematic illustration of a prior art type single piston interrupter using high density sulfur hexafluoride at supercritical pressure.

Referring first to FIG. 1, there is illustrated therein a prior art single piston device which is an interrupter incorporating sulfur hexafluoride at supercritical pressure. More specifically, in FIG. 1, the device consists of an insulation tubular housing 10 having two metallic end caps 11 and 12, respectively, at its opposite ends. A stationary contact tube 13 is fixed to end cap 11 and a cylinder 14 is fixed to end cap 12. A piston 15 is then slidably contained within the cylinder 14 and is connected to the conductive operating rod 16 which is movable in the direction illustrated by the arrow 17 in order to move the interrupter to a disengaged position. The piston 15 has extending therefrom the movable contact 18 which is contained within an insulation nozzle 19 which is fixed to the left-hand end of cylinder 14. Operating rod 16 can constitute one terminal of the device and is connected to the movable contact 18.

The cylinder 14 is provided with a plurality of apertures including apertures 20 to 23 which allow fluid flow into and out of the volume contained within the cylinder 14 and bounded between the piston 15 and end cap 12. The nozzle 19 is spaced by an annular gap 25 from the end of the movable contact structure 13. The entire interior of housing 10 is then filled with sulfur hexafluoride at supercritical pressure so that it is normally in a liquid state.

A current path is normally formed, for example, through the rod 16 to the contact 18 and then through the stationary contact 13 to a terminal such as the terminal 26 extending out of the end cap 11. In order to open the interrupter the operating rod 16 is moved to the right as indicated by the arrow 17 so that the piston 15 and movable contact 18 both move to the right. During this movement, the volume to the right of piston 15 is reduced so that fluid is driven through the openings 20 to 23 in the direction of arrows 30 and 31 in order to move the sulfur hexafluoride fluid out of the cylinder 14 and into the gap 25 and through the arc drawn between the separating contacts 13 and 18 and then back to the increasing volume to the left of piston 15.

In the prior art structure of FIG. 1 and as noted above, the pressure of the sulfur hexafluoride could be as high as 5800 PSI so that the medium is very viscous and has a high density. Consequently, very high energy is required to move the piston 15 to the right during an interruption operation. Moreover, there is an extremely high pressure surge created due to the arc between the separating contacts 13 and 18 so that very high pressure is generated within the interrupter chamber. This pressure can reach several thousands of pounds per square inch. Moreover, if the interruption occurs at very low current and low temperature, the sulfur hexafluoride pressure within the chamber can decrease due to the volumetric expansion of the sulfur hexafluoride to the left of the piston 15, thereby leading to a decrease in the dielectric withstand.

Figure 2:
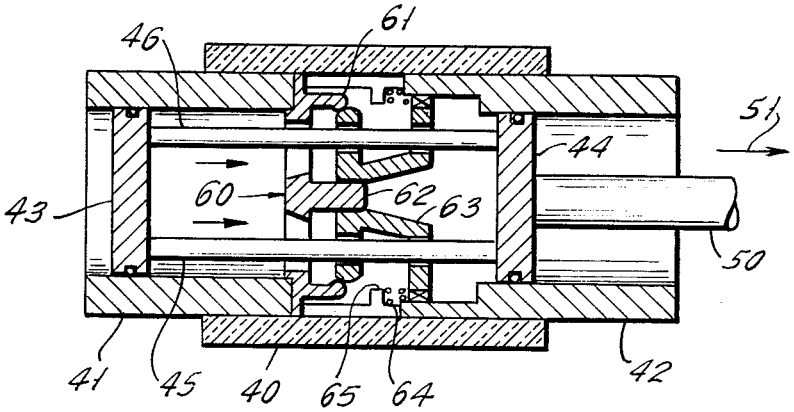
FIG. 2 (PRIOR ART)
FIG. 2 is a schematic cross-sectional drawing of a prior art interrupter using dual pistons and sulfur hexafluoride at supercritical pressure.

In order to solve some of the above problems, the prior art has used an arrangement of the type schematically shown in FIG. 2 wherein a dual piston arrangement is provided. Thus, in FIG. 2 the enclosing chamber consists of an insulation cylinder 40 which has two conductive cylinders 41 and 42 secured to its opposite ends. A dual piston arrangement consisting of pistons 43 and 44, which are of equal diameter and are secured to one another as by extending rods 45 and 46, is provided. Sulfur hexafluoride at supercritical pressure is then contained between the spaced pistons 43 and 44 which move within the cylinders formed by the tubes 41 and 42, respectively.

An operating rod 50 is then connected to the piston 44 and is movable to the right as shown by the arrow 51 in order to operate the circuit interrupter. The contacts of the interrupter of FIG. 2 include a stationary contact assembly 60 which has an outer main portion 61 and a central arcing contact 62. The moving contact assembly consists of movable contact 63 which is connected by compression spring 64 to the interior shoulder 65. The movable contact 63 is separated from stationary contact 60 by the differential force on contact 63 produced when pistons 43 and 44 move to the right.

In the arrangement of FIG. 2, the volume of sulfur hexafluoride within the interrupter is virtually constant and there is no decrease in the dielectric withstand capability during operation. However, the problem of pressure surge due to arcing will be even more severe than for the case of the design of FIG. 1. Moreover, the driving energy requirement for the design of the arrangement of FIG. 2, while lower than that of FIG. 1, will still be very high.

Figure 3:
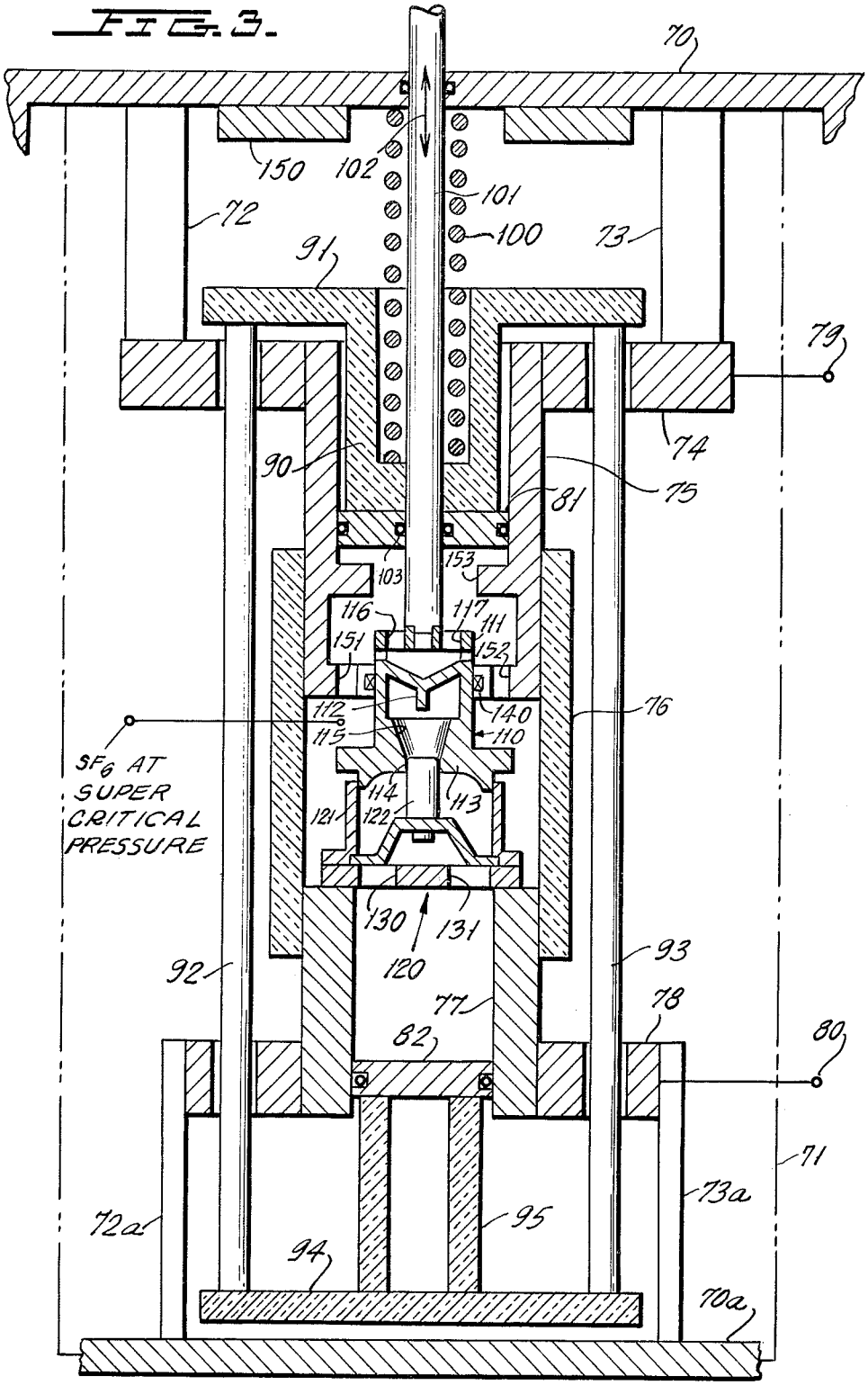
FIG. 3 is a cross-sectional view which schematically illustrates one embodiment of the present invention wherein differential pistons of different size are disposed on the opposite sides of the interrupting region of a puffer type interrupter filled with sulfur hexafluoride at supercritical pressure.

The apparatus of the present invention is schematically illustrated in FIG. 3. Referring to FIG. 3, the entire interrupter structure is illustrated as supported between end plates 70 and 70*a* with an enclosure schematically illustrated by the dotted line 71 enclosing the entire apparatus and supported from the end plate 70. The interior of the container schematically shown by the dotted line 71 may be filled with sulfur hexafluoride at low pressure.

Support insulator rods including the insulator rods 72 and 73 are suitably connected to the end plate 70 and receive a conductive ring 74. Similarly, insulators 72*a* and 73*a* connected to end plate 70*a* support conductor ring 78. Conductive ring 74 is in turn connected to a conductive cylinder 75. The conductive cylinder 75 is then received within an insulation cylinder 76 which in turn receives a conductive cylinder 77 in its lower end. The bottom end of cylinder 77 then receives conductive ring 78 to complete the stationary assembly. The interior of insulation cylinder is a sealed volume and is filled with high density $SF_6$ at a supercritical pressure, for example, 1000 PSI. Electrical terminals 79 and 80 are connected to the rings 74 and 78, respectively, and serve as the interrupter terminals.

Two pistons 81 and 82 are contained within the cylinders 75 and 77, respectively, and are the differential pistons used in accordance with the present invention. The opposing surfaces of pistons 81 and 82 are exposed to and confine the high density $SF_6$ within cylinder 76. Piston 81 has a larger diameter than the piston 82. By way of example, piston 81 may have a diameter of $5\frac{1}{2}$ inches and piston 82 may have a diameter of $4\frac{1}{2}$ inches. The pistons may be made of either conductive or insulating material.

The pistons are provided with suitable sliding seals so that they can slide easily within the cylinders 75 and 77. The seals are designed to withstand the sulfur hexafluoride critical pressure of the fluid captured in the cylindrical volume between pistons 81 and 82.

In order to interconnect the pistons so that they move with one another in an axial direction, the piston 81 is connected to a cylinder 90 having a flange 91 at one end thereof. The flange 91 then is mechanically connected to a plurality of elongated insulation rods including rods 92 and 93. The bottom ends of rods 92 and 93 are then connected to an end ring member 94 which in turn receives an elongated tube 95 which is firmly connected to the piston 82. Consequently, when member 90 is moved in an axial direction, the pistons 81 and 82 will move simultaneously for the same distance.

A compression spring 100 is then connected between the top of piston 81 and the bottom of plate 70 and presses the piston 81 and the entire piston assembly including pistons 81 and 82 downwardly and opposes the differential force on the pistons due to the pressure of the sulfur hexafluoride fluid acting on pistons 81 and 82. Electrical insulation has to be provided between the metallic spring 100 and piston 81 if piston 81 is made of conductive material. Note that a piston type pneumatic spring can be used to replace the mechanical spring. Members 90, 91, 94 and 95 can be of any desired material.

An insulation operating rod 101 passes through a seal in the plate 70 and is movable in the direction of the arrow 102 and moves along the axis of the interrupter assembly. Rod 101 passes through the plate 70 through a suitable sealing gasket which permits axial motion of the rod 101 without leakage of the low pressure sulfur hexafluoride gas. The rod 101 then passes through the piston 81 and is sealed thereto by the sealing gasket 103 which permits axial motion of the operating rod relative to the piston 81 without leakage of the dielectric fluid therethrough.

The contact system for the interrupter then includes a movable contact 110 which has a cylindrical upper section 111 which receives the operating rod 101 so that movement of the operating rod 101 in an axial direction will move the movable contact 110 axially relative to the interrupter. The movable contact 110 contains a centrally located arcing contact section 112 which is supported from a suitable support spider and contains an outer main contact cylindrical section 113 and a central arcing contact section 114 which leads to the gas flow nozzle 115 formed in the center of the movable contact. Fluid flow passages 116 and 117 permit the flow of fluid through the nozzle 115 and through the center of the movable contact.

A stationary contact assembly 120 is then fixed to the top of the conductive cylinder 77 and consists of an outer main contact cylinder 121 and a central arcing contact section 122. The outer main contact section 121 in FIG. 3 is shown in engagement with the main movable contact section 113 while the arcing contact 122 engages the arcing contact region 114 of the movable contact 110. The stationary contact 120 is also provided with a plurality of fluid flow openings including openings 130 and 131.

A current path through the interrupter is defined by a sliding contact 140 which makes sliding contact to the cylindrical upper body of the movable contact 110. Thus, a current path is formed from terminal 79 through conductive ring 74, conductive cylinder 75, contact 140, movable contact 110, the main contacts 113 and 121, the conductive cylinder 77, conductive ring 78 and terminal 80.

In order to open the circuit interrupter, the operating rod 101 is moved upwardly to move the movable contact 110 upwardly. This will then cause an initial separation of the main contact sections 113 and 121 followed by a separation of the arcing contacts 114 and 122. Thereafter, the arc will be transferred from the arcing contact 114 to the main arcing contact 112. The arc is ultimately extinguished by the flow of the arc extinguishing sulfur hexafluoride fluid which is caused to flow in the manner to be described hereinafter.

To eliminate current chopping type behavior during interruption, a plurality of flow passages including apertures 151 and 152 are provided in the bottom of the conductive cylinder 75. Note that when the movable contact 110 reaches its full upper stroke that the passages 151 and 152 and any other of the passages on the circular periphery of the bottom of cylinder 75 are blocked. Similarly, the passages through the restricted throat section 153 in cylinder 75 will also be blocked when the movable contact 110 is in its upper and fully disengaged position.

When a fault occurs, the operating mechanism is initially opened to cause an upward movement of the operating rod 101 which separates moving contact 110 from the stationary contact 120. This then causes the initial striking of an arc in the region between the arcing contacts 122 and 114. As the arc energy heats up the sulfur hexafluoride medium, the pressure of the sulfur hexafluoride increases and then generates an unbalanced force on the surfaces of pistons 81 and 82 which are on opposite sides of the arc. The unbalanced force is applied to the movable piston assembly because of the difference in the piston areas. This force will then press the piston assembly upward and as a result simultaneously accomplish three functions. First, the sulfur hexafluoride medium is forced through the nozzle 115 to assist in the extinction of the arc at an arc current zero. Secondly, the total sulfur hexafluoride volume between pistons 81 and 82 is expanded thereby to reduce the pressure surge due to arcing. Third, the movement of the piston assembly charges the spring 100 and thus stores mechanical energy in the spring.

After interruption of the arc, the pressure of the sulfur hexafluoride will return to the value it had prior to arcing and the spring 100 will reset the pistons to their original position.

The moving contact is subsequently reclosed by the operating mechanism which moves the operating rod 101 downwardly until contact reclosure occurs.

It will be further noted in FIG. 3 that a shock absorbing ring 150 of suitable material is provided above the flange 91 in order to stop and absorb energy in the movable piston assembly if it reaches the end position.

In the structure of FIG. 3, the normal position of the piston assembly including pistons 81 and 82 will be determined by the balance between the force on reset spring 100 and the differential pressure force on pistons 81 and 82 due to the normal pressure of the sulfur hexafluoride in the absence of an arc.

A principal advantage of the structure of FIG. 3 is that energy for both driving and for resetting the pistons 81 and 82 and for forcing the sulfur hexafluoride medium to flow through the separating contacts is supplied by the arc. This reduces the energy required of the operating mechanism to only that amount needed for the initial opening and resetting of the movable contact 110. Due to the short stroke (which can be as small as 1.5 inches and the small mass (which can be as small as 2000 grams) of the moving contact, the energy required of the operating mechanism is only a fraction of that required of the prior art interrupter structures of FIGS. 1 and 2.

As a further advantage of the present invention, the system has a self-regulatory feature. Thus, the problems of high pressure surge due to arcing and the decrease in the dielectric withstand after interruption of extremely low currents at low temperatures are eliminated. The self-regulating feature can be understood from the operation of the device whereby, as arcing occurs, the pressure rise associated with the arcing will press the piston assembly including pistons 81 and 82 upward. The ever-increasing spring force of spring 100 will oppose the upward motion of the pistons and will also oppose any tendency toward a reduction of the generated pressure rise as a result of the sulfur hexafluoride volume expansion when the piston 81 moves upward. Equilibrium will be reached when the various forces balance each other and the pistons 81 and 82 will slow and stop whether or not the pistons reach the end of their maximum stroke.

When performing an interruption of maximum arcing duty, the pistons 81 and 82 will travel to the extreme of their stroke and therefore generate the maximum sulfur hexafluoride volume expansion for accommodating and reducing the pressure surge due to arcing. If, however, there is an extremely low current to be interrupted, there will be no appreciable decrease in the sulfur hexafluoride pressure and thus there will be no appreciable decrease in dielectric strength. This is because the sulfur hexafluoride fluid volume expansion, caused by the opening of the moving contact 110 is very small and, furthermore, a decrease in the sulfur hexafluoride pressure will unbalance the forces on the pistons 81 and 82 and cause the pistons to move downward resulting in a reduction in the sulfur hexafluoride volume in order to compensate for the affect of the contact opening.

An additional benefit of the novel interrupter structure of the present invention is that the mechanical life of the interrupter is increased and the interrupter will require less maintenance than presently existing interrupters. This is because the piston stroke will vary depending upon the current which is interrupted. Thus, the pistons will move essentially only when there is a fault and will not move when normal rated current is being interrupted. Thus, the total number of operations of the interrupter are reduced leading to an increase in the expected life of the device.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. An electrical interrupter comprising:

contact means separable to produce an electric arc in an arcing region;

an elongated enclosure means enclosing said arcing region; said enclosure means having first and second cylinder regions on opposite respective ends thereof; said contact means supported within said enclosure means;

high density electronegative fluid at supercritical pressure filling said enclosure means and said arcing region;

first and second coaxial pistons slidably disposed in and sealing said first and second cylinders respectively; said first piston having a greater area exposed to said fluid than said second piston, and mechanical means fixing said first and second pistons to one another whereby they move simultaneously and in the same axial direction;

biasing means connected to said first and second pistons for biasing said first and second pistons to a given axial location relative to said arcing region under the influence of a given fluid pressure of said fluid; said biasing means biasing said first and second pistons for movement in an opposite direction to the differential force on said pistons due to said fluid pressure;

and operating means connected to said contact means for separating said contact means and producing an arc, whereby the increased fluid pressure produced by said arc moves said first and second pistons and moves said fluid through said arcing region, and whereby pressure surges are limited by the expansion of the volume within said enclosure means due to the movement of said pistons therein.

2. The interrupter of claim 1 wherein said pistons are cylindrical in shape.

3. The interrupter of claim 1 wherein said fluid is sulfur hexafluoride.

4. The interrupter of claim 1 further including nozzle means connected to said contact means; said nozzle means forming a fluid flow passage through the arc produced in said arcing region.

5. The interrupter of claim 1, 2, 3 or 4 wherein said contact means includes a stationary contact and a movable contact; said movable contact being fixed to said operating means.

* * * * *